United States Patent [19]

Buchla

[11] Patent Number: 4,628,785

[45] Date of Patent: Dec. 16, 1986

[54] METHOD AND APPARATUS FOR CALIBRATING A KEYBOARD

[75] Inventor: Donald F. Buchla, Berkeley, Calif.

[73] Assignee: Kimball International, Inc., Jasper, Ind.

[21] Appl. No.: 745,889

[22] Filed: Jun. 18, 1985

Related U.S. Application Data

[63] Continuation-in-part of Ser. No. 577,854, Feb. 7, 1984, Pat. No. 4,558,623.

[51] Int. Cl.[4] ..... G10H 1/34

[52] U.S. Cl. ..... 84/1.1; 84/1.27; 84/DIG. 7; 340/365 E; 200/5 A; 200/6 R

[58] Field of Search ..... 84/1.01, 1.1, 1.27, 84/DIG. 7; 340/365 E; 200/5 R, 5 A, 6 R

[56] References Cited

U.S. PATENT DOCUMENTS

| | | | |
|---|---|---|---|
| 3,507,970 | 4/1970 | Jones | 84/1.01 |
| 3,634,593 | 1/1972 | Nagano | 84/1.01 |
| 3,715,447 | 2/1973 | Ohno | 84/1.24 |
| 3,836,909 | 9/1974 | Cockerell | 340/365 C |
| 3,927,593 | 12/1975 | Kawamura | 84/1.01 |
| 3,943,812 | 3/1976 | Nagai et al. | 84/1.1 |
| 4,027,569 | 6/1977 | Luce et al. | 84/1.1 |
| 4,033,219 | 7/1977 | Deutsch | 84/1.03 |
| 4,213,367 | 7/1980 | Moog | 84/1.22 |
| 4,416,178 | 11/1983 | Ishida | 84/1.19 |
| 4,420,744 | 12/1983 | Jesson | 340/365 E |
| 4,469,000 | 9/1984 | Fujiwara et al. | 84/1.1 X |

*Primary Examiner*—Stanley J. Witkowski

*Attorney, Agent, or Firm*—Jeffers, Irish & Hoffman

[57] ABSTRACT

A calibration system for the keyboard of an electronic musical instrument. Compression of the key causes an output signal to be generated which varies in accordance with the amount of key depression. When the key is depressed to a nominally fully depressed position, the system stores an offset value relating to the difference between the actual output signal at this point and an expected reference output signal which would occur if the keyboard were perfectly adjusted from a mechanical standpoint. The offset value is stored in the memory and added to the key output signal during the normal operate mode of the instrument so that the output signal is adjusted in accordance with the offset value stored during the calibrate mode.

14 Claims, 6 Drawing Figures

METHOD AND APPARATUS FOR CALIBRATING A KEYBOARD

CROSS REFERENCE TO RELATED APPLICATIONS

This is a continuation in part of application Ser. No. 577,854, filed Feb. 7, 1984, and now U.S. Pat. No. 4,558,623.

BACKGROUND OF THE INVENTION

The present invention relates to a keyboard, such as the keyboard for a musical instrument, and in particular to an electrical system and method for calibrating the keyboard to provide for uniformity of response.

In prior art electronic keyboards, such as those used in musical instruments such as organs and electronic pianos, an electric or electronic switch is closed when the key has been depressed a certain degree to thereby indicate to the electronic circuitry that the key has been struck. Some keyboards are touch responsive whereby the output from the keyboard varies depending on the velocity with which the key is struck. One typically used system for determining key velocity is to time the transition of the key from its undepressed state to a fully depressed state wherein the amount of time elapsed is inversely proportional to the velocity with which the key is struck. In other prior art keyboards, piezoelectric devices or other force transducers are used.

In many prior art keyboards, both those used in electronic musical instruments and in other applications, it is important to provide an output signal which corresponds to the level of key depression that the performer or keyboard operator determines is the fully depressed position of the key. The performer normally detects this through a tactile sensation, such as when the key bottoms out against a stop. However, the mechanical adjustment of keyboards and keys within a keyboard can vary substantially so that the signal indicating full key depression may occur before or after the point at which the performer or operator assumes the key has been fully depressed.

In the aforementioned Pat. No. 4,558,623, which application is incorporated herein by reference, there is disclosed a prior art keyboard system wherein the position of the key is detected by a movable pickup that moves within an electrostatic field formed between a pair of stationary electrodes. The pickup never contacts either of the electrodes, but the voltage impressed on the pickup varies as a function of the pickup within the electric field so that as the key is depressed and the pickup is moved within the field, the voltage impressed thereon changes with position. In that particular keyboard, the voltages impressed on the stationary contacts are substantially of equal amplitude, but 180° out of phase so that at the midpoint of the pickup between the stationary electrode, the voltage impressed thereon is substantially zero. The system is designed to be responsive to this critical zero voltage level and provide an output signal that indicates the key is "fully closed". Further depression of the key beyond this point produces a signal of opposite polarity, which is sensed and used by the system as an aftertouch control. The performer determines that the key has been fully depressed through a tactile sensation when the key impacts against a resilient stop, such as a Poron washer or the like.

In a keyboard such as this, it is important to generate the critical output voltage at exactly the point where the key contacts the resilient stop, or at least the performer perceives the key as contacting the resilient stop, because the time between the beginning of key closure and the sensing of the critical voltage level informs the system of the velocity with which the key is struck. Any further depression of the key beyond this point is sensed as aftertouch, which provides a variable voltage that can be processed by the system to generate tremelo or other musical effects common to aftertouch manipulation of the key.

A problem which many prior art keyboards is that the mechanical switch structure is not uniform from key to key, so that when two keys are depressed to what the performer perceives as their fully depressed positions, the trigger or switch closure signals are not produced at the same time. In the keyboard system of Pat. No. 4,558,623, for example, if one of the stationary contacts or the movable contact is bent or otherwise not perfectly mechanically adjusted, the zero voltage level will be reached at a point other than what the performer perceives as full key closure. This results in non-uniform switch response and unpredictable aftertouch control.

SUMMARY OF THE INVENTION

The present invention relates to a keyboard system wherein the keys can be easily calibrated so that the key closure trigger signal is produced at the position of key closure which the performer perceives as the "fully depressed" position. This is accomplished by generating and storing an offset signal for each key which is combined with the actual output signal during playback to compensate for irregularities in the mechanical key switch structure or adjustment. In the calibrate mode, the output signal from the key at the nominal full closure position of the key is used to generate and store an offset which is related to the difference between the output signal at this position of the key and the expected predetermined reference signal if the key were perfectly mechanically adjusted. This offset value is then recombined with the output signal from the key in the operate mode to convert the actual output signal to a normalized output signal to compensate for the amount of mechanical irregularity.

In the preferred embodiment, the amount of key depression is sensed by a movable electrode moving within an electrostatic field formed between two stationary electrodes wherein there is a voltage gradient within the electrostatic field that is a function of the displacement relative to the electrodes. The voltages on the electrodes are of substantially equal amplitude and opposite phase so that when the movable electrode is at the midpoint of the electrostatic field, the voltage impressed thereon is substantially zero. This zero voltage level is sensed by the processing circuitry as an indication of full key closure but prior to movement into the aftertouch range. The key velocity can be determined either by the amount of time between key initiation and full key closure, or by the amount of travel of the key into the aftertouch region following full key closure, such as disclosed in copending application Ser. No. 746,245, filed on even date herewith. Said application is expressly incorporated herein by reference.

In the preferred embodiment, once the key is depressed to the fully depressed trigger level, the system senses key closure, and any further depression of the key produces an output signal that varies in amplitude in accordance with further key closure into the aftertouch region. A resilient stop is positioned in the mechanical key linkage so that the key linkage contacts the resilient stop at about the point of full key closure, yet the key is capable of traveling past this position into the aftertouch range by further compressing the resilient stop.

In the calibrate mode, when the key is depressed to the point where the key engages the resilient stop, further depression is avoided and the key is released. The system senses the cessation of further depression of the key and stores an offset signal that bears a relation to the output voltage from the movable electrode at this point of key closure. If the output voltage at this point is zero volts, which would indicate a perfectly mechanically adjusted key, then a zero offset is stored. However, if the key has been depressed past the point of the zero volt trigger level, the stored offset will be the amount of travel into the aftertouch range which, when combined with the actual output signal when the system is in the operate mode, will convert the output signal to a zero volt value at this point so that the system will detect full key closure at the same point that the performer perceives the key as being at full key closure, thereby compensating for the mechanical irregularity.

The invention is not limited to musical instrument keyboards, but could be used in other types of keyboards where precision and key actuation is important. Although the term "depression" has been used, it should be understood that this term is not limited to the downward movement of the key, but, rather, relates to the movement of any control element such as a key, knob or the like in a direction to produce an output signal indicating actuation of the control device.

The present invention, in one form thereof, constitutes a keyboard system for use in an electronic keyboard musical instrument comprising a key actuatable from a rest position to a nominally depressed reference position, and key output means connected to the key for producing an actual key output signal which varies in accordance with the degree to which the key is depressed. A keyboard trigger circuit operatively connected to the key output generates a keydown trigger signal responsive to an expected reference value of the key output signal corresponding to the key nominally depressed position, and a calibrate system is responsive in a calibrate mode to the key reaching the nominally fully depressed position for generating and storing an offset value relating to the difference between the expected reference value of the key output signal and the actual key output signal value produced when the key reaches the nominally fully depressed reference position. An offset circuit is responsive in an operate mode of the keyboard system for retrieving and combining the offset value with the actual value of the key output signal to convert the actual value to the expected value when the key reaches the nominally depressed reference position, thereby to compensate for irregularities.

A method according to one form if the invention relates to a method for playing and calibrating a keyboard system having a key actuatable from a rest position to a nominally depressed reference position. The method comprises depressing the key and producing an actual key output signal that varies in accordance with the depression of the key, calibrating the system by depressing the key to the reference position and storing an offset value equal to the difference between the actual key output signal at the reference position of the key and an expected reference value of the key output signal, and, when the system is in the operate mode, combining the offset value with the actual key output signal to produce a calibrated resultant signal corresponding to the position of the key normalized to the reference position.

It is an object of the present invention to provide a calibrate system for a keyboard wherein nominally fully depressed positions of the keys can be easily calibrated to thereby compensate for mechanical irregularities in the key structure and adjustment.

It is a further object of the present invention to provide a calibration system for a keyboard which enables the keyboard to be custom calibrated to the partircular touch of the performer.

DETAILED DESCRIPTION OF A PREFERRED EMBODIMENT

Figure 1:
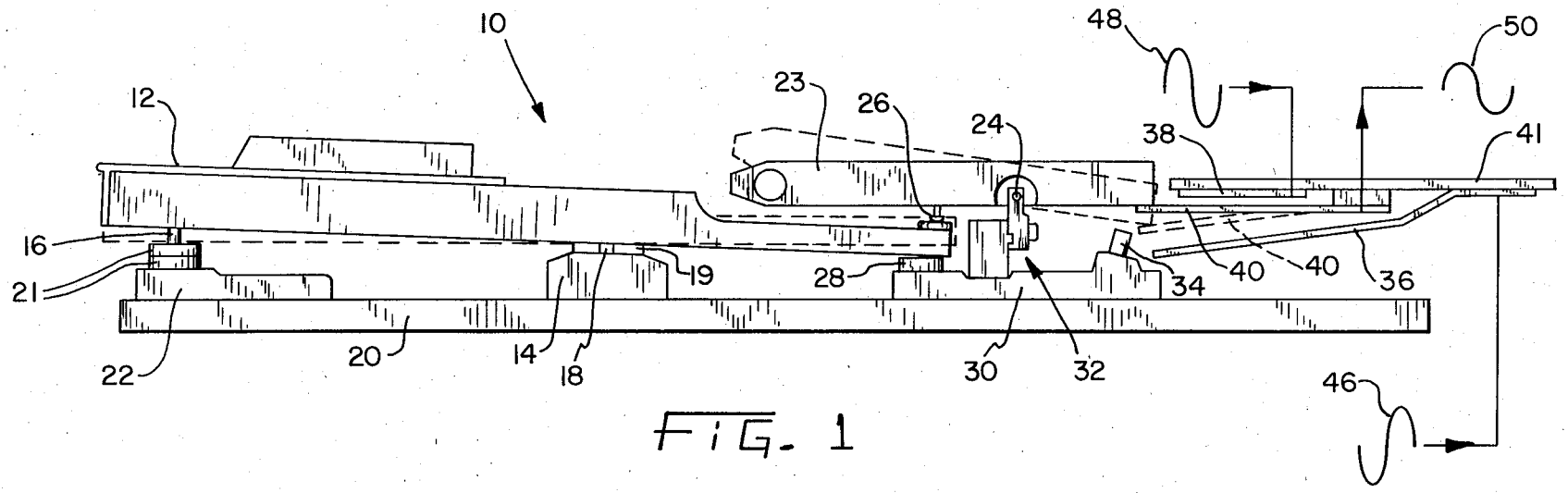
FIG. 1 is a side elevational view, partially in section, showing a key in its rest position and a fully depressed position shown by dashed lines.

With reference now to FIG. 1, a keyboard 10 in a preferred embodiment of the invention comprises a plurality of playing keys 12, one of which is shown, and which are linearly arranged in the usual fashion as in a piano or organ keyboard The keys may be made of wood or plastic and are supported on a base 20. A pair of pins 16 and 18 secured to base 20 serve to locate the key linearly with respect to base 20. Pin 18 is surrounded by a felt washer 19, and block 14 serves as the fulcrum point for key 12.

Figure 2:
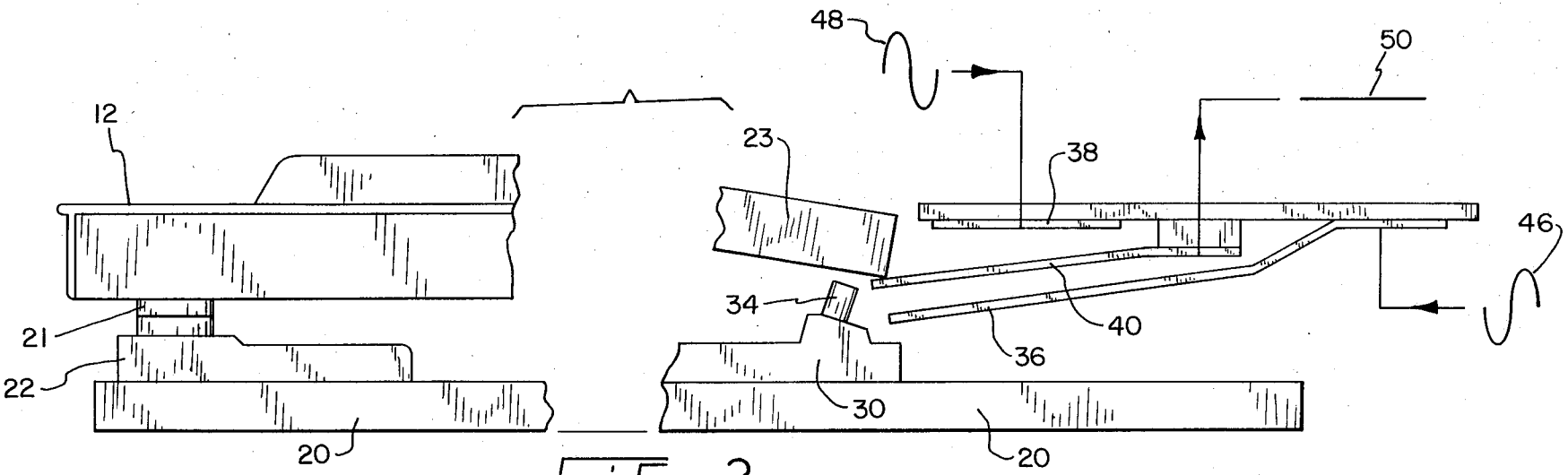
FIG. 2 is an enlarged, fragmentary view similar to FIG. 1 wherein the key has been depressed past its rest position to its normal fully depressed position.
Figure 3:
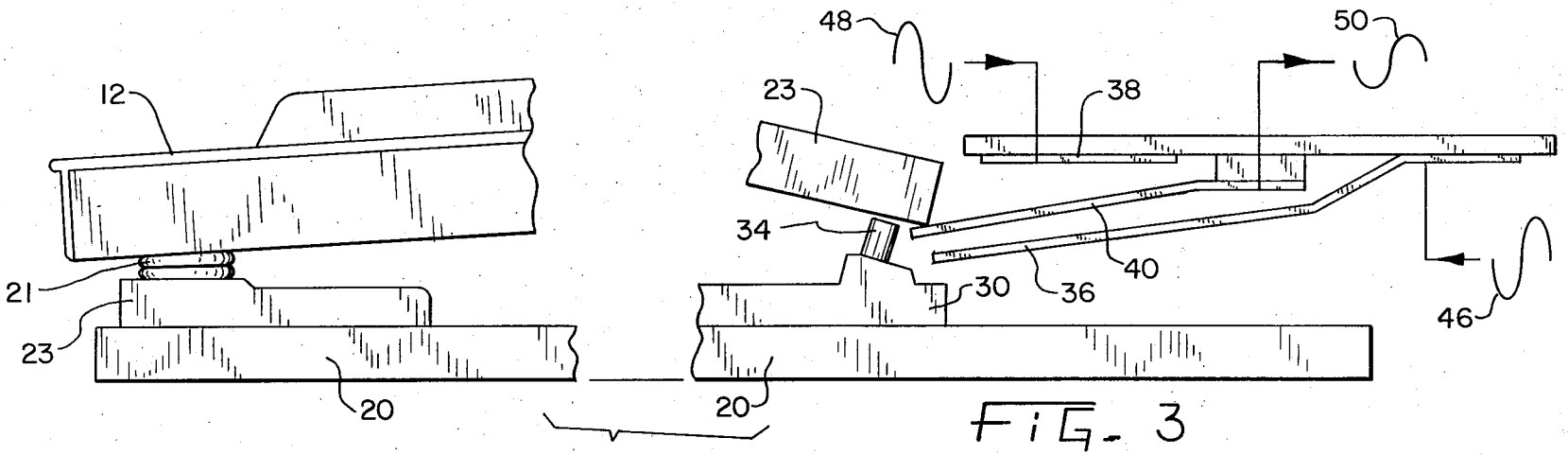
FIG. 3 is an enlarged, fragmentary view similar to FIG. 1 wherein the key has been depressed past its fully depressed position into an overtravel position.

Pin 16 is secured to stop member 23 and has circumferentially disposed thereon a pair of resilient washer-like stop members 21 made of a yieldable resilient material so that the lower surface of the key 12 contacts washers 21 when key 12 is depressed by the performer to its nominal fully depressed position. Washers 21 are preferably made of a resilient rubber-like material such as Poron. Since stop members 21 are compressible, key 12 can be depressed past its normal fully depressed position as shown in FIG. 2 where it just touches stop members 21 into an overtravel or aftertouch range where stop members 21 are compressed as illustrated in FIG. 3. Thus, stop members 21 will be compressed to a greater or lesser extent depending upon the amount of force with which key 12 is struck and/or the amount of aftertouch force exerted on the key after it has reached its nominally fully depressed position as illustrated in FIG. 2.

The rearward end of key 12 includes an actuating stancion or pin 26 for contacting and rotating actuator 23 as key 12 is struck. Actuator 23 is support on pivot pin 24 for pivoting movement thereabout as illustrated by the dashed line position in FIG. 1. A rest stop 28 made of felt or the like is provided for the rearward end of key 12 for normally supporting key 12 in its rest position, and stop 28 is supported on member 30, which also supports a mounting assembly 32 on which stancion 26 is supported. Actuator stop 34 is mounted on support member 30 and is contacted by actuator 23 at about the limit of its travel.

An electrically insulating circuit board 41 serves as the base for supporting three electrodes 36, 38 and 40, wherein electrodes 36 and 38 are stationary and electrode 40 is moveable from a rest position where it is adjacent electrode 38 to an actuated position where it is adjacent stationary electrode 36. Moveable electrode 40 is moved within the electrostatic field developed between electrodes 36 and 38 in a downward direction in response to key depression. FIG. 1 illustrates moveable electrode 40 in solid line in its rest position and in dashed line when moved to a reference position by movement of key 12 to the nominally fully depressed position.

Thus, it can be seen that as key 12 is struck, actuator 23 will be rotated and cause moveable electrode 40 to move downwardly in proportion to the amount of key depression. Depending on the force with which key 12 is struck or the amount of pressure applied after key 12 contacts resilient stop member 21, stop member 21 will be compressed and moveable electrode 40 will be moved even closer to stationary electrode 36.

A sinusoidal alternating voltage 46 is applied to stationary electrode 36, and an alternating sinusoidal voltage 48, which is equal in amplitude to signal 46 but opposite in phase, is applied to stationary electrode 38. Signal 48 will be referred to as the positive phase signal and signal 46 as the negative phase signal. The two alternating sinusoidal voltages 46 and 48 generate an electrostatic field between electrodes 38 and 36, and moveable electrode 40 will be impressed with a voltage from the electric field which is a function of its position relative to electrodes 36 and 38. Due to the voltage gradient in the electrostatic field between electrodes 36 and 38, the position of moveable electrode 40 can be detected by detecting the voltage impressed thereon.

Referring now to FIGS. 1, 2 and 3, when key 12 is in the rest position as shown in solid line in FIG. 1, the voltage on moveable pickup 40 is very close to the voltage 48 on upper stationary electrode 38 because of the proximity of pickup 40 to electrode 38. However, as shown in FIG. 2, when key 12 is depressed to its nominally fully depressed position where it just touches resilient stop member 21, moveable pickup 40 is moved to the position indicated wherein the voltage impressed upon pickup member 40 is substantially zero as indicated by waveform 50. Because of the alternating system of signals 46 and 48 and because they are 180° out of phase, the signals will just cancel at a certain point in the electros-tatic field intermediate electrodes 36 and 38, and this point has been chosen as the position of pickup 40 when key 12 just contacts resilient stop member 21. When key 12 is pressed further past the position of FIG. 2 into the aftertouch range as illustrated in FIG. 3 wherein stop member 21 is compressed, moveable pickup 40 is moved closer to lower stationary electrode 36, which carries the negative phase signal 46, thereby producing an output signal 50 of the same negative phase as signal 46 but of lower amplitude. However, the amplitude of signal 50 will increase the closer that moveable electrode 40 is moved to lower stationary electrode 36.

Figure 4:
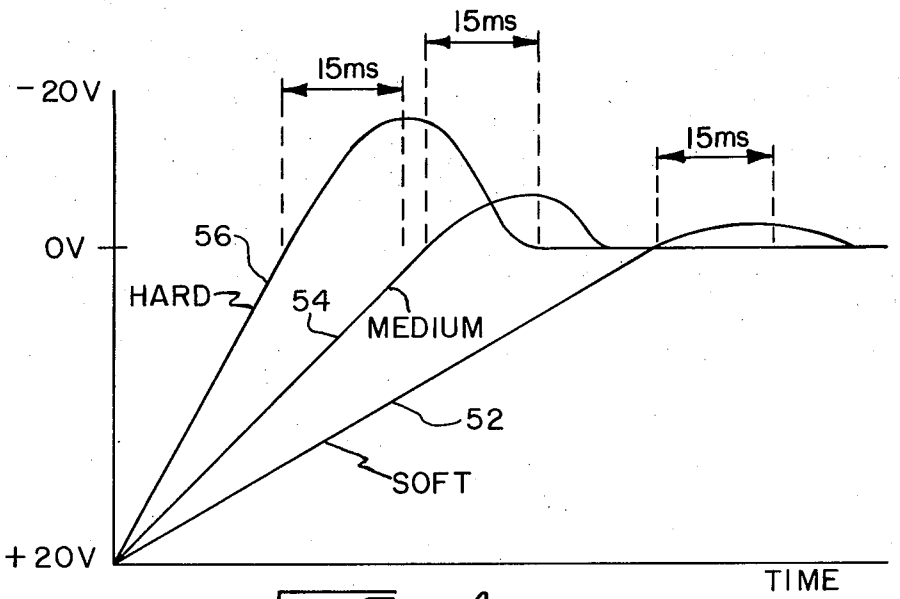
FIG. 4 is a graph illustrating three curves indicating voltage on the pickup contact versus time in response to the depression of the key at three different velocities.

FIG. 4 illustrates the manner in which the key system of FIGS. 1, 2 and 3 can be utilized.to provide an output signal representative of the velocity with which the key is struck. This type of system is disclosed in detail in the aforementioned copending patent application Ser. No. 746,245 filed on even date herewith. Since the actuation of key 12 is dynamic, the voltage 50 on pickup member 40 changes as a function of time. The abscissa represents the elapsed time from the time that the key 12 has begun to be depressed, and the ordinate shows the peak amplitude of the voltage impressed on pickup member 40. The system is responsive to the first half of a full cycle of the waveform, so the voltage will be positive under the influence of positive phase signal 48 and negative under the influence of negative phase signal 46.

When key 12 is struck softly, the peak voltage on moveable pickup member 40 varies as shown by curve 52. If key 12 is struck more foreably, the output is shown by curve 54, and if the key 12 is struck very hard, the output signal is represented by curve 56. As illustrated by the graphic representation in FIG. 4, when key 12 is struck, it will overtravel past the nominally depressed position of FIG. 2 into the aftertouch region of FIG. 3 wherein resilient stop member 21 is depressed. The moveable contact 40 will move into the negative voltage region for a time and then fall back into the positive voltage region as key 12 is released. The harder the key is struck, the higher the peak amplitude of voltage impressed on moveable pickup 40, as is apparent from comparing curve 56 with curve 54, for example.

In a tone generation system, it is possible to utilize this impact information to provide an output signal representative of the force with which the key is struck, and such a system is disclosed in the aforementioned copending application filed on even date herewith. For example, by causing a timing operation to be initiated once zero volt output from moveable contact 40 is detected, and then sampling the voltage a predetermined time later, for example, 15 milliseconds, the amplitude at the sample time will be proportional to the force with which the key has been struck. This is shown by comparing the peak voltages 52, 54 and 56 for soft, medium and hard actuation of key 12. Furthermore, the amplitude over time of the output signal once the key has been depressed into the aftertouch range can be used to adjust tremelo depth, frequency changes or other musical effects commonly controlled by aftertouch actuation of a key.

The present invention is concerned not with the manner in which the key information is utilized, but is concerned with a technique for calibrating the keyboard so that the usable output signal will be zero volts at the point that the key has been depressed to its nominally fully depressed position, regardless of mechanical irregularities, such as bent electrodes 36, 38 and 40, or irregularities in the analog processing circuitry. As can be seen from the example of the system of FIG. 4, the point at which the output from the key is at the reference voltage, arbitrarily selected in this case to be zero volts, is critical to the operation of the system, and if the contacts become bent or there are other irregularities, then the timing sequence will not start exactly on time, and the amplitude a predetermined time later will not be consistent from key to key.

Figure 5:
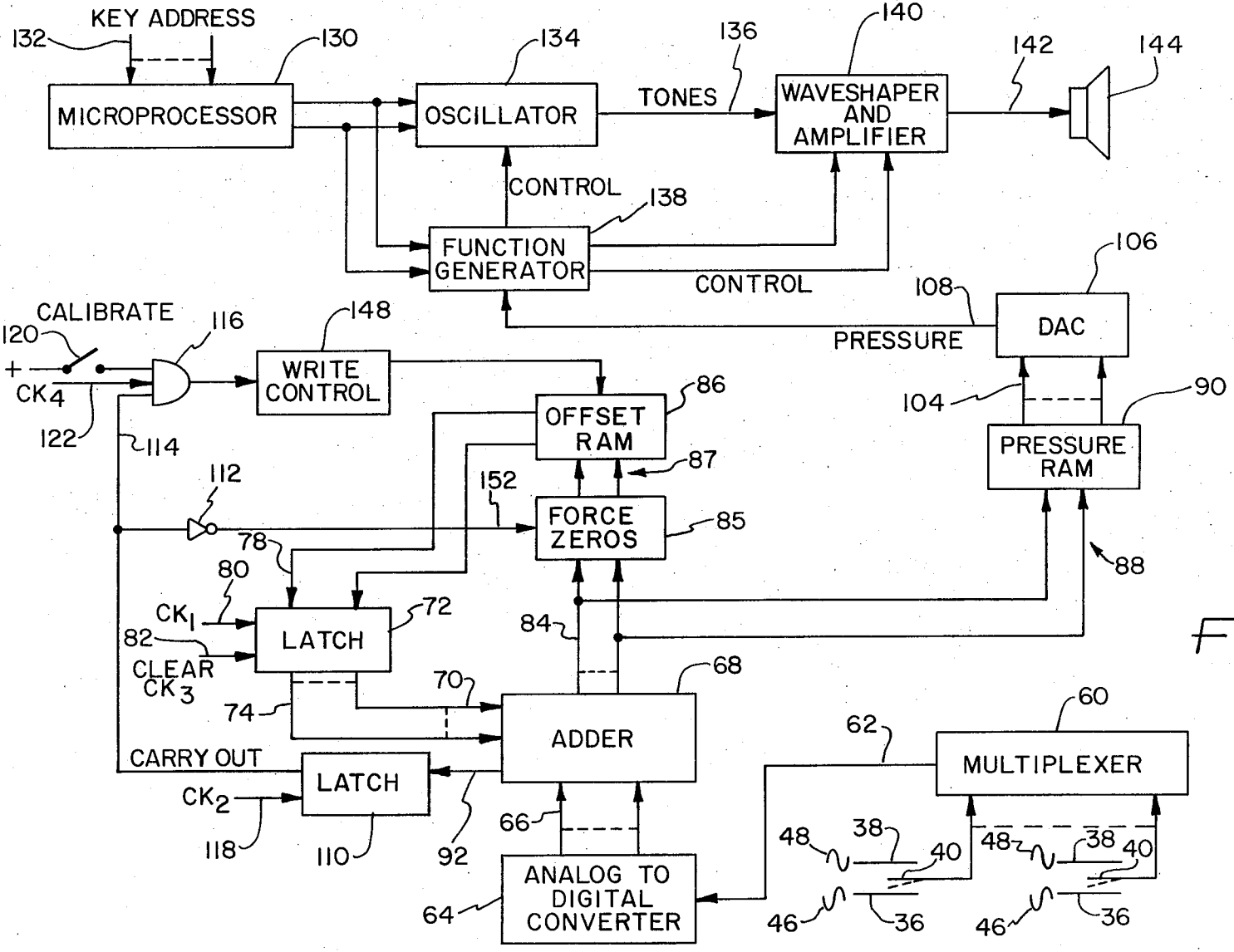
FIG. 5 is a block diagram of the calibration system of the present invention incorporated into a keyboard musical instrument.

FIG. 5 illustrates an offset system according to one form of the present invention. The peak first half cycle outputs from moveable pickups 40 for the various keys 12 are detected and multiplexed by multiplexer 60 so that the system can process the data on a time shared basis. Such multiplexing is conventional in nature, and for this reason, the present invention is described only in terms of one of the keys. In customary fashion, the memory devices, microprocessor and other circuit devices in the system are commonly addressed and timed in order to process the data on a time shared basis.

The output 62 from multiplexer 60 is connected to the input of an analog to digital converter 64, which converts the analog signal on line 62 to an eight bit digital word on output 66. The output produced by the analog to digital converter is an increasing binary number for negative voltages on line 62.

Adder 68 adds the input on line 66 to the binary number on line 70 from inventing latch 72, the output 74 of which is the complement of the input, to produce on input 70 of adder 68 a complement of the binary number on the input 78 of latch 72. Latch 72 is clocked by the $CK_1$ signal on line 80, and cleared by the $CK_3$ signal on line 82.

The output 84 of adder 68 is connected to the input of the zero forcing circuit 85 to the input 87 of offset random access memory 86, and is also connected to the input 88 of pressure random access memory 90. Adder 68 includes a carry output 92 which is at a logic 1 level when adder 68 overflows.

RAM 86 is addressed in synchronism with multiplexer 60 so that the data for the individual keys 12 can be stored in the appropriate locations. The output 104 from pressure RAM 90 is connected to the input of digital to analog converter 106, which produces an analog pressure signal on output 108 that varies proportionally to the digital input on line 104. Pressure RAM 90 is connected to adder 68 by lines 88.

Carry output 92 is connected through latch 110 to one of the inputs 114 of AND gate 116. Latch 110 is clocked by the $CK_2$ signal on clocking input 118.

In order to place the system in the calibrate mode, switch 120 is closed, thereby enabling AND gate 116 to pass the $CK_4$ clocking signal on line 122 when the carry signal from latch 110 is present on input 114.

A microprocessor 130, which is synchronized with the other parts of the system by a key address signal on line 132, controls oscillator 134 to produce tones on its output 136. Oscillator 134 is also controlled by a function generator 138, which in turn is under the control of microprocessor 130. Function generator 138 is also responsive to the pressure signal on line 108 to control waveshape and amplifier circuit 140 as well as oscillator 134 to control the volume of the tone, the timbre and other effects. Amplifier output 142 is connected to a speaker 144 in order to produce audible tones. An example of the control which can be exercised by function generator 138 is that of volume control, which may vary depending on the velocity with which the key is struck, to simulate an acoustic piano. Furthermore, aftertouch control will cause the pressure signal 108 to vary, and function generator 138 can utilize this information to modify the frequency of oscillator 134 or the timbre control of waveshaper 140.

The output of AND gate 116 actuates write control 148 to cause offset RAM 86 to write at the appropriate location the offset value on input 87. Clocking signals $CK_1$, $CK_2$, $CK_3$ and $CK_4$ are generated in sequence so that the latching and gating functions will occur in the proper order, in the manner set forth hereinafter.

The calibration system operates as follows. The system is placed in the calibrate mode by closing switch 120, which enables one input of AND gate 116. The relationship between contacts 36, 38 and 40 is such that moveable contact 40 will sense zero volts just prior to key 12 coming into contact with resilient stop member 21. With calibrate switch 120 closed, key 12 is depressed, but since adder 68 will not overflow, there is no carry-out signal on line 92, and the inversion of this signal through inverter 112 is connected to the input 152 of force zeros circuit 85, which forces the storage location for the particular key 12 being depressed also to all zeros. On the receipt of the $CK_1$ signal on line 80, latch 72 will latch the complement of the output of RAM 86 to the input 70 of adder 68. This will be the complement of the all zeros value stored in the RAM, which will be a value of all ones. Because adder 68 has still not overflowed, output 92 will be at logic zero.

As soon as moveable contact 40 moves just past the zero voltage position in the electrostatic field between electrodes 36 and 38, analog to digital converter 64 will receive a slightly negative value on line 62, and will convert this value to an absolute binary number value greater than zero on input 66 to adder 68. Upon the receipt of clock pulse $CK_1$ on line 80, latch 72 will latch into input 70 of adder 68 all ones, and this will cause adder 68 to overflow and produce on its carry output 92 a logic one. When the $CK_2$ signal is received on line 118, latch 110 will latch this value, and upon the receipt of clock pulse $CK_3$, latch 72 will be cleared. This is followed by clock pulse $CK_4$, which activates write control 148 to write into offset RAM 86 the value on the output of adder 68, which is the sum of the binary number on 66 and the all zero output of latch 72, which has been cleared by pulse $CK_3$. Force zero circuit 85 will be disabled by the inverted carry out signal from inverter 112.

As key 12 continues to be depressed, pickup 40 will move closer to lower electrode 36, thereby producing increasingly higher analog values on output 62 of multiplexer 60 for that particular key time slot. Correspondingly, the input 66 to adder 68 will be increasingly larger, and adder 68 will remain in its overflow condition because on each cycle, the current value on input 66 to adder 68 will be added to the complement of the smaller previous value, thereby resulting in overflow. The latched carry-out signal on line 92 will maintain AND gate enabled so that the output of ADC 64 will be in effect passed through by adder 68 when latch 72 is cleared by the $CK_3$ pulse an stored in offset RAM 86 upon receipt of the $CK_4$ pulse.

When key 12 comes into contact with resilient stop member 21, however, the performer ceases further depression of key 12. Since the output voltage on pickup 40 will remain constant, the output of ADC 64 will be the same for two successive cycles. Latch 72 will retrieve the previous offset value from RAM 86, which is the value at the furthest depression of key 12, and adder 68 will add the complement of the previous offset value to the current offset value which will result in output from adder 68 of all ones. This will also cause the carry-out signal to disappear on line 92, thereby disabling gate 116 and avoiding writing over the previously stored offset value. As key 12 is released, AND gate 116 will remain disabled and the stored offset value will remain in RAM 86 for retrieval in the operate mode.

Figure 6:
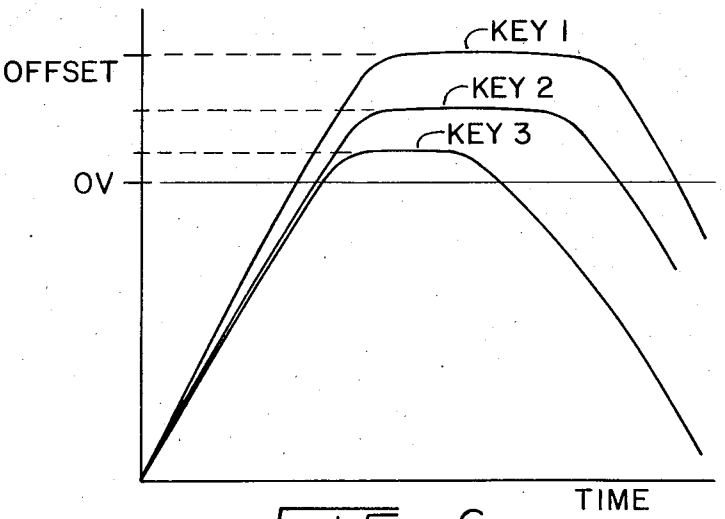
FIG. 6 is a graphic representation of the output signals for three keys in the calibrate mode.

Although the calibrate procedure for only ohe key has been described, the same procedure is used for all keys 12 in a time shared fashion as determined by multiplexer 60. FIG. 6 illustrates three hypothetical key closures and the relationship between the offset values which would be stored depending on the amount of travel the key passed the zero volt condition until it strikes resilient stop 21.

In the operate mode, switch 120 is open thereby disabling write control 148 so that no further values will be written over the stored offset values in RAM 86, and timing control 96 is enabled. When a particular key 12 is depressed, the analog value on line 62 from pickup 40 is converted by analog to digital converter 64, and at the same time, the offset value from RAM 86 is latched into the other input of adder 68. Adder 84 then produces on its output 84 a digital number which is offset by the complement of the offset value stored during the calibrate sequence, and this normalized value is stored in RAM 90 for use by the tone generation system at that time or a future time. The output 104 from RAM 90 is converted to an analog voltage by digital to analog converter 106, and this signal by be used by the system as previously described.

While this invention has been described as having a specific embodiment, it will be understood that is is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A keyboard system for use in an electronic keyboard musical instrument comprising:

a key actuatable from a rest position to a nominally fully depressed reference position, key output means connected to said key for producing an actual key output signal which varies as a function of the distance which the key is depressed, keydown trigger means operatively connected to said key output means for generating a keydown trigger signal responsive to an expected reference value of the key output signal corresponding to the key nominally fully depressed reference position, calibrate means responsive in a calibrate mode of the keyboard system to the key reaching the nominally fully depressed position for generating and storing an offset value relating to the differnece between the expected reference value of the key output signal and the actual key output signal value produced when the key reaches the nominally fully depressed reference position, and offset means responsive to said keydown trigger means in an operate mode of the keyboard system for retrieving and combining the offset value with the actual value of the key output signal to convert the actual value to the expected value when the key reaches the nominally fully depressed reference position thereby to compensate for irregularities in the key or key output means.

2. The keyboard system of claim 1 wherein said key output means includes an analog to digital converter means connected to said key for generating a digital number corresponding to the actual output signal, and said offset means includes an adder means having one input connected to said analog to digital converter means to receive the digital number and another input connected to said calibrate means to receive the retrieved offset value, said adder means combining the offset value and digital number to produce said expected value.

3. The keyboard system of claim 1 wherein said key is further depressible beyond the reference position, and including means responsive to such further depression and to the actual key output signal for generating a signal indicative of the velocity with which the key is depressed based on the amount of travel of the key past the reference position.

4. The keyboard system of claim 3 including a resilient stop means contacted by said key for yieldably limiting the movement of said key past the reference position, the reference position being about the position of the key when the key contacts the resilient stop means.

5. The keyboard system of claim 4 wherein said key output means comprises an electrode connected to the key and moveable in an electrostatic field by said key, the electrostatic field impressing on said key a voltage varying with the position of the electrode in the field.

6. The keyboard system of claim 1 wherein said key is further depressible beyond the reference position, and said key output means produces an actual key output signal corresponding to the amount of further depression of the key past the reference position, and including control means for combining the offset value and actual key output signal corresponding to such further depression to generate a control signal bearing a relation to said expected reference value corresponding to the amount of key depression beyond the reference position.

7. The keyboard system of claim 6 wherein said control means includes an adder means for adding together the offset value and key output signal to produce the control signal.

8. A keyboard system comprising:

a key actuatable from a rest position to a nominally fully depressed reference position, the reference position being determined by mechanical resistance to the key, key output means connected to said key for producing an actual key output signal which varies as a function of the distance which the key is depressed, keydown trigger means operatively connected to said key output means for generating a keydown trigger signal responsive to an expected reference signal corresponsing to the key nominally depressed reference position, the actual value of the key output signal being capable of differing from the expected reference value depending on key and output means irregularities, calibrate means responsive in a calibrate mode of the keyboard system to the key reaching the nominally fully depressed position for generating and storing an offset value relating to the difference between the expected reference signal and the actual key output signal value produced when the key reaches the nominally fully depressed reference position, and offset means responsive in an operate mode of the keyboard system for retrieving the offset value and being responsive to the key output signal and offset signal for producing said reference signal when the key reaches the nominally depressed reference position.

9. The keyboard system of claim 8 wherein said key is further depressible beyond the reference position, and said key output means produces actual key output signals corresponding to the amount of further depression of the key past the reference position, and including control means responsive to the actual key output signal corresponding to such further derpession and to the offset value to generate a control signal bearing a relation to said expected reference signal corresponding to the amount of key depression beyond the reference position.

10. The keyboard system of claim 9 including a resilient stop means contacted by said key for yieldably limiting the movement of said key past the reference position, the reference position being about the position of the key when the key contacts the resilient step means.

11. The keyboard system of claim 10 wherein said key output means comprises an electrode connected to the key and moveable in an electrostatic field by said key, the electrostatic field impressing on said key a voltage varying with the position of the electrode in the field.

12. A keyboard system comprising:

a key actuable from a rest position to a reference position, key output means for producing a digital key output signal which varies as a function of the distance which the key is depressed, memory means for storing a digital offset value for said key, keydown trigger means operatively connected to said key output means for generating a keydown trigger signal responsive to an expected reference value of the key output signal corresponding to the reference position, adder means connected to the output of said key output means for adding to the digital key output signal the offset value stored in said memory to thereby produce a second digital output signal, and calibrate means responsive in a calibrate mode for sensing when said key is in said reference position for storing in said memory means the offset value relating to the difference between the expected reference value and the actual key output signal when the key is in the reference position.

13. The keyboard system of claim 12 wherein said memory means includes a random access memory and means for producing the complement of an output from the random access memory.

14. The method of playing and calibrating a keyboard system having a key actuatable fron a rest position to a nominally depressed reference position comprising:

depressing the key and producing an actual key output signal that varies as a function of the distance of depression of the key, calibrating the system by depressing the key to the reference position and storing an offset value equal to the difference between the actual key output signal at the reference position to the key and an expected reference value of the key output signal at the reference position, and when the system is in an operate mode, combining the offset value with the actual key output signal to produce a calibrated resultant signal corresponding to the position of the key normalized to the reference position.

* * * * *

UNITED STATES PATENT AND TRADEMARK OFFICE

CERTIFICATE OF CORRECTION

PATENT NO. : 4,628, 785

DATED : December 16, 1986

INVENTOR(S) : Donald F. Buchla

It is certified that error appears in the above-identified patent and that said Letters Patent is hereby corrected as shown below:

Col. 3, line 59, change "if" to --of--.
Col. 4, line 14, change "partircular" to --particular--.
Col. 5, line 58, change "electros-tatic" to --electrostatic--.
Col. 8, line 67, change "ohe" to --one--.
Claim 1, Col. 9, line 48, change "differnece" to --difference--.
Claim 9, Col. 11, line 6, change "derpession" to --depression--.
Claim 10, Col. 11, line 16, change "step" to --stop--.
Claim 12, Col. 11, line 24, change "actuable" to --actuatable--.

Signed and Sealed this

Fourteenth Day of April, 1987

*Attest:*

DONALD J. QUIGG

*Attesting Officer*

*Commissioner of Patents and Trademarks*